US007163474B1

(12) United States Patent
Skinner et al.

(10) Patent No.: US 7,163,474 B1
(45) Date of Patent: Jan. 16, 2007

(54) PORTABLE BACKSTOP AND SPORT EQUIPMENT SET, BASEBALL RELATED GAME, AND PLAYING FIELD

(76) Inventors: Brady Joseph Skinner, 817 Masonic Ave., San Francisco, CA (US) 94117; Mathew Scott Colby, 4906 NE. Grand Ave., Portland, OR (US) 97211

( * ) Notice: Subject to any disclaimer, the term of this patent is extended or adjusted under 35 U.S.C. 154(b) by 0 days.

(21) Appl. No.: 10/905,781

(22) Filed: Jan. 20, 2005

(51) Int. Cl.
*A63B 69/00* (2006.01)
*F41J 5/06* (2006.01)
*A63B 63/00* (2006.01)
*A63B 67/00* (2006.01)

(52) U.S. Cl. ..... 473/454; 473/421; 473/468; 273/381

(58) Field of Classification Search ..... 473/454–456, 473/421, 468; 273/398–402, 381
See application file for complete search history.

(56) References Cited

U.S. PATENT DOCUMENTS 3,583,703 A * 6/1971 Brown et al. ..... 473/456
3,706,451 A * 12/1972 Dixon ..... 273/383
4,295,648 A * 10/1981 Stromback ..... 473/456
4,497,485 A * 2/1985 Macosko ..... 473/435
4,629,188 A * 12/1986 Mahieu ..... 473/454
5,348,291 A * 9/1994 Scully ..... 473/454
5,460,363 A * 10/1995 Tomer ..... 473/454
5,573,240 A * 11/1996 Humboldt ..... 473/454
5,944,318 A * 8/1999 Payton ..... 273/402
6,264,570 B1 * 7/2001 Yoon ..... 473/197
6,402,641 B1 * 6/2002 Lee ..... 473/446
6,878,078 B1 * 4/2005 Swanson ..... 473/454
2004/0038759 A1 2/2004 Kuzia ..... 473/478
2005/0075199 A1 * 4/2005 Babiak et al. ..... 473/468
2005/0288129 A1 * 12/2005 Lewis ..... 473/454

* cited by examiner

*Primary Examiner*—Mark S. Graham
(74) *Attorney, Agent, or Firm*—Steven A. Nielsen; Allman & Nielsen, P.C.

(57) ABSTRACT

A lightweight backstop, equipment set, method of defining a playing field and method of playing a baseball related game is provided. The invention integrates a ball stopping backstop, attached strike zone, foul line ropes and base hit markers with methods and means for defining and marking a playing field scaled to the size and number of players. A separate strike zone is attached to the backstop by means allowing the players to quickly change the vertical position of the strike zone and acoustical responses generated by balls hitting the strike zone. Players may also adjust the sound generated by balls missing the strike zone, but striking the backstop net. One embodiment of the disclosed game eliminates base running and ball throwing near batters after the ball has been struck. The entire equipment set is light weight, easy to move, and simple to assemble.

10 Claims, 3 Drawing Sheets

PORTABLE BACKSTOP AND SPORT EQUIPMENT SET, BASEBALL RELATED GAME, AND PLAYING FIELD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A COMPUTER PROGRAM

Not Applicable.

BACKGROUND OF THE INVENTION

1. Field of the Invention

The present invention relates to a sporting equipment set, backstop, method and means for defining a playing field, and method of playing a baseball related game, all suitable for use with a regulation baseball, Wiffle™ ball or other light weight balls or baseball equipment.

2. Description of Relevant Art

U.S. Pat. No. 5,573,240 discloses a relatively heavy target sheet indiscriminately attached to a backstop generating only one particular sound when a ball strikes the target material. U.S. Pat. Application No. 20040038759 discloses a sport net relying on relatively hard, non collapsible material to generate an invariable sound when struck. These devices have a number of shortcomings.

First, the construction of the target zones or strike zones in the related art is limited to material that is acoustically different from the surrounding backstop or backstop net. The related art relies upon differences in the material of the strike zone and backstop to achieve a louder noise when balls hit the strike zone material.

Second, the related art fails to address the need for ball players to adjust the sound generated by balls striking the strike zone or backstop. As a result, ball players wishing to practice pitching or batting on an informal or warm-up basis must endure the distraction of loud target noises and commentary from bystanders, parents or coaches.

Third, the related art does not give players the option of having the backstop generate a louder noise than the strike zone or target zone. Practicing pitchers may prefer to associate a calming silence with balls thrown on the strike zone. Unlike the related art, the present invention allows independent adjustment of sound levels generated by either the strike zone or backstop net.

BRIEF SUMMARY OF THE INVENTION

The present invention presents a backstop, equipment set, method of scaling a playing field to the size and number of ball players and method of playing a safer baseball related game that overcomes problems of the related art by allowing numerous adjustments to the backstop, strike zone, equipment set and field dimensions to suit the needs, size and number of players.

One object of the invention is to provide recreational players of baseball and baseball related games a light weight, portable, and quickly assembled backstop and equipment set suitable for use with regulation baseballs or lightweight balls. One or two players may bring the equipment set to a park, quickly assemble the backstop, adjust the location and acoustical properties of the strike zone and practice pitching and/or hitting. As more players arrive, foul line ropes attached to the backstop may be used to define the playing field.

In order to scale the playing field to the size and number of players, a player is selected to pace or walk a number of steps from the home plate to define the position of the pitcher's plate. In fairness to smaller players, the playing group may select the shortest player to pace or walk the playing field dimensions.

The width of the playing field is defined by placement of the foul line ropes, which are first attached to the backstop, and then extend outward in a straight line, toward and past the pitcher's plate. The foul line ropes roughly form two sides of a triangle. The far ends of the foul line ropes may be considered home run markers.

In one embodiment of the invention, base markers are attached to the foul line ropes, balls are batted, and if uncaught on the fly, are assigned a base value determined by the ball's relative position to the base markers. Balls landing outside of the foul line ropes are considered foul balls with no base value In one embodiment of the invention bases are not run. The value of a base hit, single, double, etc. is noted on a score card or represented on a small chart. Players and/or base hits represented on the chart or score card are advanced from base to base as other base hits occur. The remaining rules follow those of traditional baseball.

The disclosed game accommodates small and varying numbers of players by adjusting the number of player paces or steps used to define the playing field. Adding players to a game in progress merely requires additional paces between the pitcher's plate and singles markers, located on the foul line ropes. Since each foul line rope may be attached to the backstop, one player can simply pull the far end of a foul line rope to a new position.

The disclosed game, backstop and related equipment set reduce the risk of injury and confrontation between players by use of the base markers to judge the value of uncaught batted balls, absence of players running bases, and by use of sounds generated when balls hit the strike zone or backstop. The players may adjust the sound generated when balls hit the strike zone and may independently adjust the sound generated when balls hit the backstop. The related art fails to provide such adjustments, merely providing a single loud or thumping sound when balls hit the strike zone.

Unlike the related art, the disclosed backstop and equipment set allow pitchers and batters the option of practicing without distracting sounds, by adjusting the net and strike zone to be quiet. Players are able to practice and develop skill in a relaxed environment. As the players' confidence and competitiveness increase, the tension in the backstop net or strike zone may be changed, creating audible differences between balls striking either component. The audible differences lessen the likelihood of player disputes over the judgment of strikes and balls.

In one embodiment of the invention, tension cords are used to adjust the acoustics of the strike zone, allowing the strike zone to be comprised of material similar to that of the net. The related art relies upon the use of heavy or canvas material to comprise the strike zone and lighter or different material to comprise the net.

BRIEF DESCRIPTION OF THE SEVERAL VIEWS OF THE DRAWING

The present invention is depicted by way of example, and not by limitation, in the figures of the accompanying drawings and in which like reference numbers refer to similar elements and in which.

DETAILED DESCRIPTION OF THE INVENTION

The disclosed backstop may be used to stop balls, hold the strike zone, and/or secure foul line ropes and is suitable for single player practice, multiplayer practice and competitive games involving two or more players. The backstop utilizes a separate strike zone, which may be made from any type of collapsible material similar or dissimilar to the material comprising the net. In the preferred embodiment, the strike zone is comprised of plastic.

Strike Zone

Figure 1:
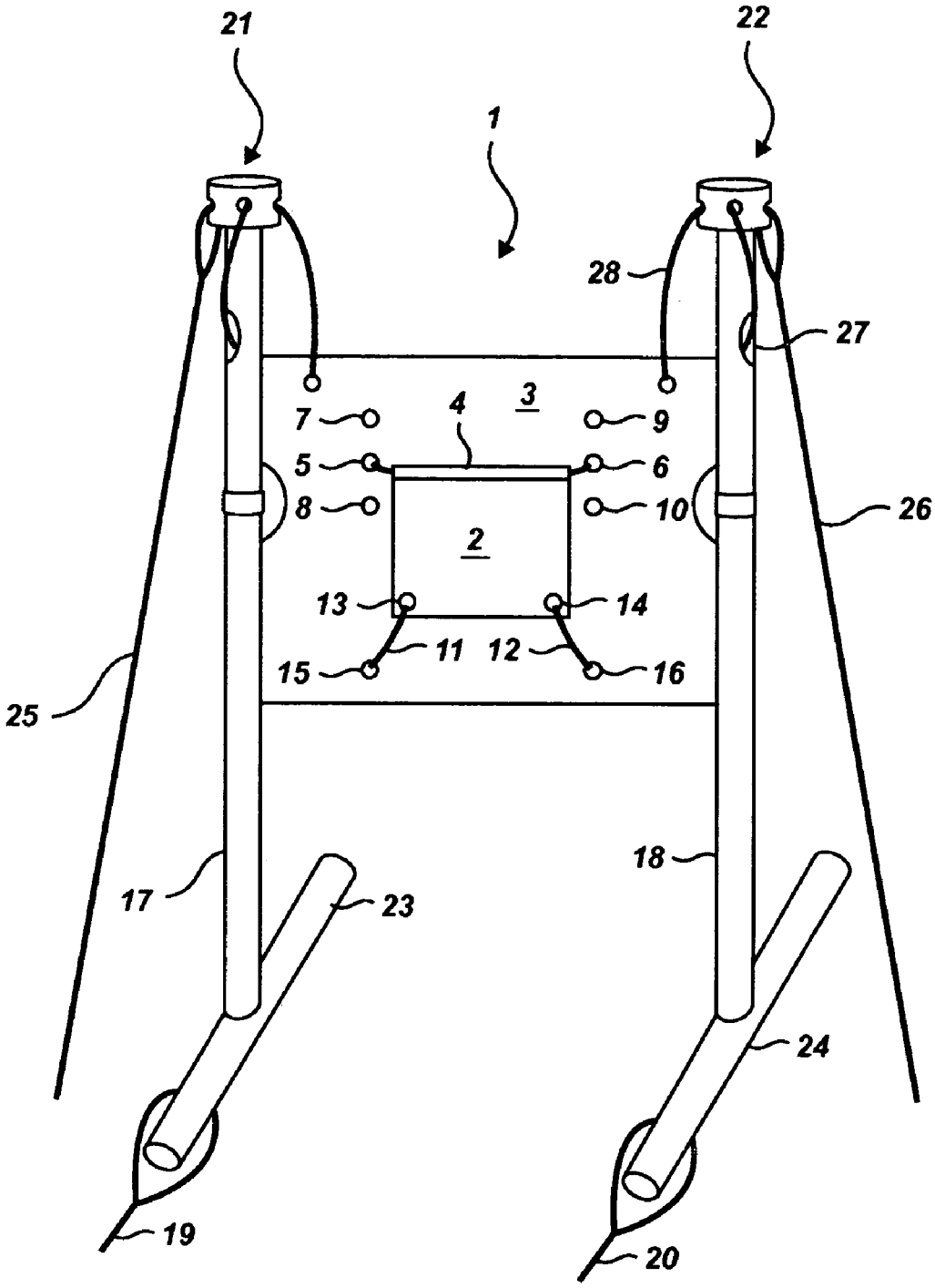
FIG. 1 is a front perspective view of the backstop.

The backstop and related equipment set are shown generally 1 on FIG. 1. The strike zone 2 or target zone is preferably 76 centimeters or 30 inches high and 43.2 centimeters or 17 inches wide, and may be used to determine if a pitched ball is deemed a strike. A pitched ball hitting the strike zone may be considered a strike, a pitched ball missing the strike zone and hitting the net may be considered a ball. A pitched ball missing both the strike zone and backstop may be considered a ball.

The disclosed invention provides means for adjusting the sound produced by balls striking the strike zone. The acoustical properties of the strike zone may be adjusted by use of tension cords or rope attached to the strike zone and net. The tension cords could also be attached to the strike zone and backstop frame.

The strike zone 2 may be moved vertically on the net 3. The strike zone is preferably attached to a strike zone holder 4 which may be a single solid part, similar to a clothes hanger having an approximate length equal to the width of the strike zone. The strike zone holder is preferably attached to the top end of the strike zone, and connects to the net preferably through openings in the net, such as 5, 6. The ends of the strike zone holder may have a hook shape and pass through the net openings.

The net may have two vertical columns of openings 7, 5, 8, and 9, 6, 10 spaced apart at a distance of approximately the width of the strike zone.

In the preferred embodiment of the invention, two strike zone tension cords 11, 12 attach to the net and to the lower portion of the strike zone at 13, 14. The net may have two lower openings 15,16 to accept the strike zone tension cords. Tension or the length of the strike zone tension cords may be adjusted by use of fasteners on the back side of the net. The back side net tension cord fasteners should be of greater diameter than the lower openings 15, 16 of the net.

The disclosed strike zone attachment method allows for quick replacement of the strike zone in the event of breakage or in the event the players desire to attach their own unique strike zone. The present invention contemplates players fabricating their own strike zones to suit their own visual and auditory preferences.

Net

The net 3 FIG. 1 is attached to vertical supports, or as in the preferred embodiment, finished vertical supports 17, 18. The net may be used to stop balls and/or generate a variable sound when struck. The net may be comprised of any collapsible material. In the preferred embodiment, commercial grade knitted polyester 60% shade screen is used. The 60% value means that the net material blocks 60 percent of the light from the sun.

Figure 3:
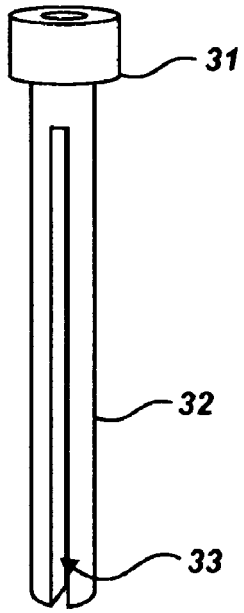
FIG. 3 is a side perspective view of a bottom vertical large diameter hollow support.
Figure 4:
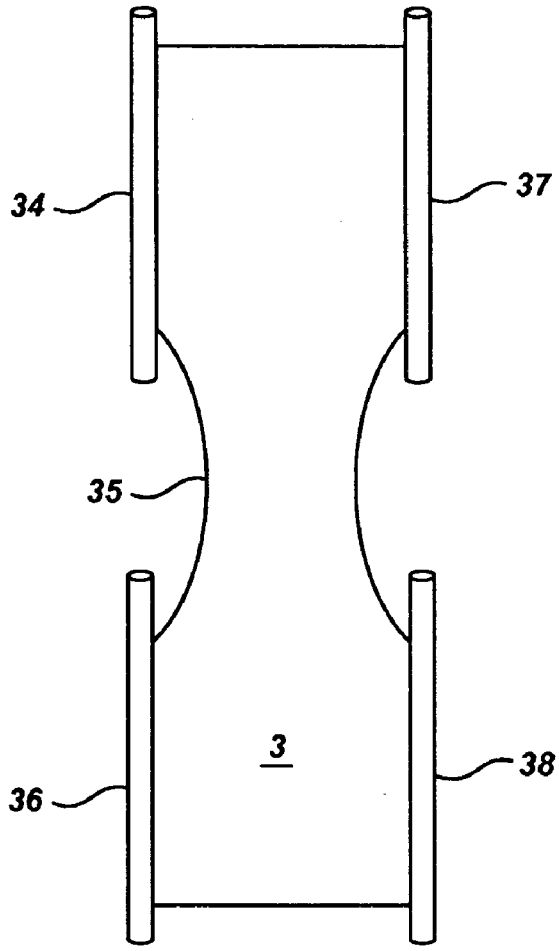
FIG. 4 is a front perspective view of four vertical smaller diameter net holders attached to a net.

In the preferred embodiment, either vertical side of the net 3 of FIG. 4 is attached to two vertical smaller diameter wooden net holders such as 34, 36 as shown on FIG. 4. A total of four or more vertical smaller diameter net holders 34, 36, 37, 38 are attached to the net. The net is preferably 2.4 meters or 8 feet wide and 2.4 meters or 6 feet high. The vertical smaller diameter net holders allow the net to collapse into a smaller carrying bag. A carrying bag for the equipment set may be made smaller by use of additional vertical net holders and additional vertical large diameter hollow supports, 29, FIGS. 2 and 32, FIG. 3.

Backstop Frame

The backstop frame 17, 18 FIG. 1, may be comprised of any rigid material, such as PVC pipe and may include the use of base pieces 23, 24 to increase stability.

Rope or cords 25, 26 may be attached to the backstop frame or top caps 21, 22 and attached to the ground to add stability.

Finished Vertical Supports

In the preferred embodiment FIG. 1, the backstop frame 17, 18 is comprised of two finished vertical supports that fit into two base pieces 23, 24. The base pieces may be comprised of PVC pipe, and lay flat on the ground. The finished vertical supports attach approximately to the center of the base pieces, at an approximate right angle.

Figure 2:
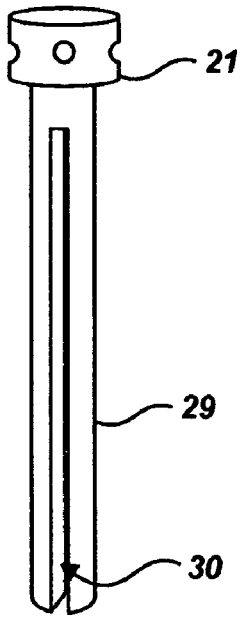
FIG. 2 s a side perspective view of a top vertical large diameter hollow support.

Each finished vertical support may be comprised of two vertical smaller diameter net holders 34, 36 FIG. 4 and two vertical larger diameter hollow supports 29, FIGS. 2 and 32, FIG. 3. The net is attached to the four smaller vertical net holders 34, 36, 37, 38 FIG. 4. The two smaller vertical net holders of one side, 34, 36 FIG. 4 slide into a top vertical larger diameter hollow support, 29 FIG. 2 and a lower vertical larger diameter hollow support, 32 FIG. 3, respectively. A locking collar 31 secures the larger diameter and smaller diameter vertical net supports. An arc 35 FIG. 4 may be cut into the net to allow the locking collar 31 to wrap around the entire perimeter of the finished vertical net support.

The upper vertical larger diameter hollow support 29 FIG. 2 is shown with a top cap 21 on FIG. 2.

The net of the finished vertical support extends through the vertical openings 30, 33 of the vertical larger diameter hollow supports 29, 32.

In the preferred embodiment, top caps 21, 22 FIG. 1 attach to the top of each finished vertical net support 17, 18 and have preferably 4 or more openings of approximately 0.64 centimeters or ¼ of an inch in diameter. Openings in the top caps may be used to accept net tension cord(s), 28 attached to the net and backstop frame or finished vertical net support at 27. Ropes, twine, tension cords, piano strings, or like material may be used to adjust the vibrations, tension, acoustics, sound, pitch, and/or tambour of sound generated by balls striking the net or strike zone. Openings in the top caps may also be used to secure ropes or cords 25, 26 to the ground or other stabilizing object.

Equipment Set

The equipment set includes, but is not limited to, the backstop, backstop frame, net, strike zone, strike zone holder, finished vertical supports, vertical large diameter hollow supports, vertical small diameter net holders, base pieces, tension cords, ropes, vertical net supports, foul line ropes, base hit markers, carrying bag, and written instructions pertaining to game play and/or assembly of the equipment set.

The foul line ropes 19, 20 FIG. 1 are preferably at least 22.8 meters or 75 feet in length, brightly colored, and attached to the backstop. In the preferred embodiment, the foul line ropes attach through openings in the base pieces.

Figure 5:
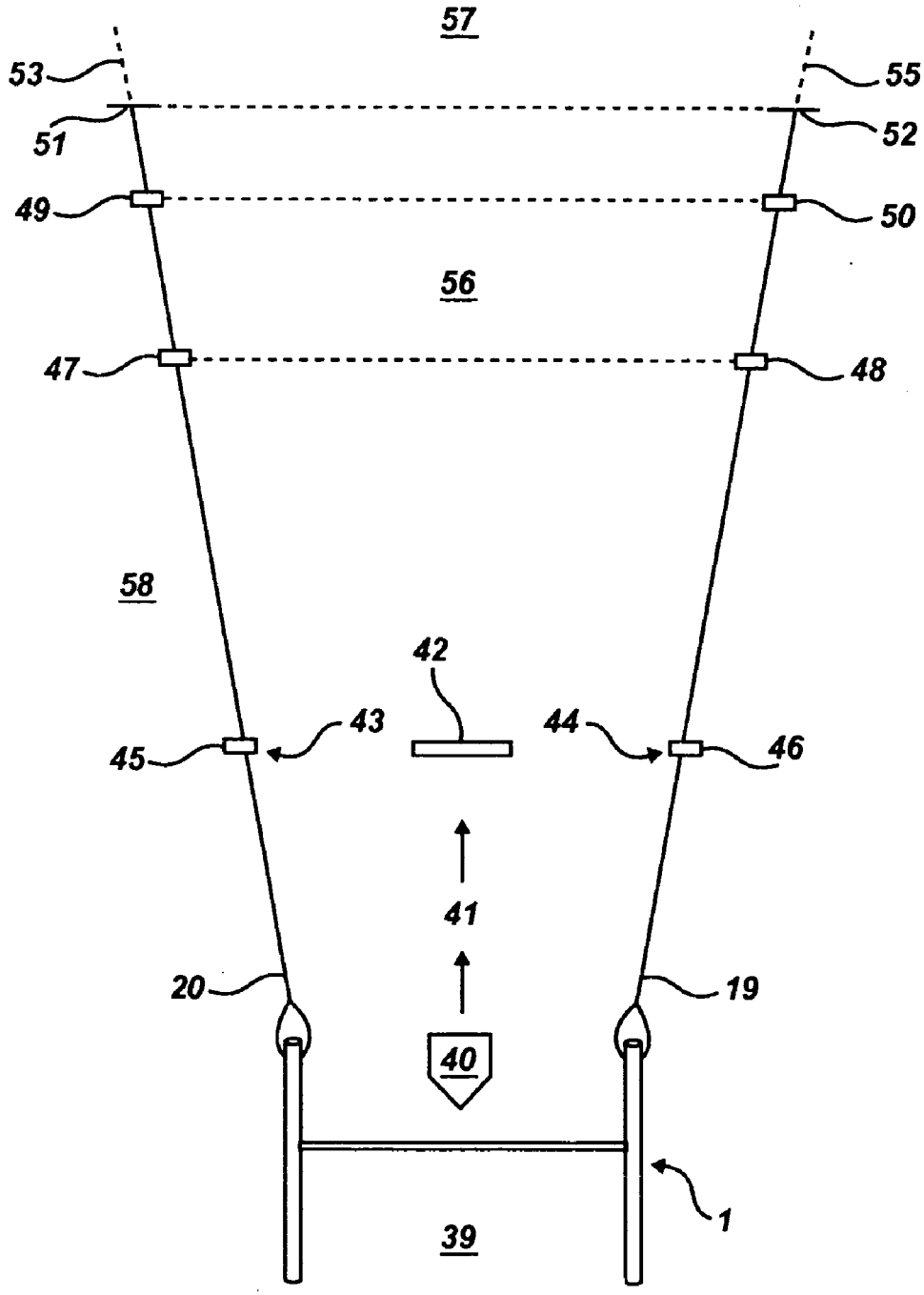
FIG. 5 is a top perspective view of the disclosed playing field.

The base hit markers 45, 46, 47, 48, 49, 50 FIG. 5 are preferably brightly colored and attached to the foul line ropes. Tennis balls may be used as base hit markers and may be attached to the foul line ropes by openings in the tennis balls. The tennis balls stay secured to the foul line ropes and are easily moved into position, preferably to the positions described in the disclosed playing field and/or illustrated in FIG. 5.

The Playing Field

To define the boundaries and location of components of the playing field, player steps or paces, or fractional distances may be used. Players may choose any player or person to pace the needed distances. The number of paces can be increased or decreased at the discretion of the players. The number of paces is preferably increased for a greater number of players. The use of player paces scales the playing field to the physical size of the player(s). Increasing the number of paces as the number of players increase scales the playing field to the number of players.

The preferred embodiment of the disclosed method and means of defining and marking the disclosed playing field is shown on FIG. 5 and is described, as follows:

A home plate, preferably a five sided rubber slab 40, FIG. 5 may be placed in front of a backstop 1, FIG. 5 such as the backstop of claim 11. A player or other designated person walks a number of paces from the home plate to locate the pitcher's plate 42. Alternatively, a player may pace a distance from the pitcher's plate to locate the home plate. A distance of 13 steps or paces between the pitcher's plate and home plate is preferable. The direction and path paced between home plate and the pitcher's plate is illustrated at 41.

Once the pitcher's plate 42 is set a player then paces a number of steps from either side of the pitcher's plate, in directions 43 and 44 which are perpendicular to the path 41 between the pitcher's plate and home plate. For a one-on-one game, a distance of 6 paces is preferable, for teams of two, 6 paces is preferable, for teams of three or more, 7 paces is the preferable distance.

The points paced from the pitcher's plate along directions 43 and 44 are used to locate the first base hit markers or singles markers 45, 46 which are attached to the foul line ropes 20, 19. The foul line ropes may be secured to the backstop, positioned in a straight line, intersecting the singles markers and continuing to the far ends or home run markers, 51, 52 which may be staked into the ground.

The second and third base markers, or doubles and triples markers are then set along the foul line ropes. Player paces may be used to locate the doubles and/or triples markers, but in the preferred embodiment, fractional distances are used. In the preferred embodiment the doubles marker 47 is attached to the foul line rope 20, at the half way point between the singles marker 45 and the far end of the foul line rope 51. The process is repeated on the other foul line rope 19 to place the other doubles marker 48. The triples markers 49, 50 are then attached to the foul line ropes at points half way between the doubles markers and foul line end points or home run markers.

A Baseball Related Game

The disclosed game is preferably played with the disclosed backstop, equipment set and played on the disclosed playing field. The disclosed game may be considered a variant to the popular and well known game of baseball.

The disclosed game may also be considered integrated with, or part of, the disclosed playing field and equipment set by the contemplated inclusion of a written copy of the rules of the game and method of defining the playing field, in the carrying bag, or the printing of the rules and method on any of the components of the equipment set.

The disclosed game adopts the rules of traditional baseball unless otherwise stated. One of the objects of the disclosed game is to incorporate the disclosed backstop, equipment set and playing field to comprise an informal game suitable for play with relatively few players and in smaller park settings. The disclosed game, equipment set and playing field contemplate the use of traditional baseball bats and balls or light weight bats and balls such as those made of plastic, including but not limited to Wiffle Ball™ products.

The preferred embodiment of the disclosed game is as follows:

Two teams of one or more players each play on the scaled field as disclosed above and illustrated in FIG. 5. The goal of each team is to win by scoring more runs than the opposing team. The team scoring the most runs at the conclusion of a regulation game is deemed the wining team.

The infield 56 and outfield 57 and foul lines 20, 19 are fair territory, and all other areas, such as 58 and 39 are foul territory.

A pitcher standing on the pitcher's plate throws a ball in the direction of the home plate. Pitched balls striking the strike zone of the backstop are deemed strikes. Balls missing the strike zone are deemed balls. The batter may adjust the strike zone and/or net to achieve the sound he or she desires to hear when a ball strikes the net or strike zone. Sounds generated by balls striking the net or strike zone may be used to determine if a pitched ball was a strike or ball.

A batted ball that is uncaught on the fly earns a base hit value dependent upon the ball's landing location with respect to the base hit markers. For example, a ball landing in the area between the singles and doubles markers 45, 46, 47, 48, would earn a single base hit. A ball landing in foul territory 58, outside of the foul line ropes, would not earn a base it, but would be considered a strike or foul ball as in traditional baseball.

An uncaught batted ball landing at 56 between the doubles and triples markers would earn a double base hit. An uncaught batted ball landing between the triples and home run markers 49, 50, 51, 52 would earn a triple base hit. Uncaught batted balls landing past the home run markers 51, 50 but within the imaginary fair ball territory lines 53, 55, earn a home run value.

An uncaught batted ball landing within the foul line ropes but short of the pitcher's plate is a foul ball. A batted ball hitting the ground and still moving when fielded cleanly by the pitcher results in an out. Fielding the ball cleanly means that the pitcher picks up the moving ball without dropping the ball or bobbling the ball in his or her hands. A batted ball hitting the ground and passing the pitcher results in a single base hit.

To decrease the risk of injury from base sliding, player collisions, batted or thrown balls, and avoid undue physical exertion, batters do not run the bases, and the fielding team merely pitches balls to batters and attempts to catch batted balls. This method of play is well suited for young players and mature players wishing to enjoy baseball activity without the formalities and risks of injury associated with traditional baseball.

Base hit values are noted on a chart or score card. Players represented on the score card advance as team members earn base hits.

A variation of the disclosed game calls for players to run the bases.

What is claimed is:

1. A backstop comprising:

(a) a backstop frame;

(b) a net attached to the backstop frame;

(c) a strike zone comprised of collapsible material attached to the net by means allowing changes to the acoustical responses generated when the strike zone is struck;

(d) four or more vertical large diameter hollow supports that accept four or more vertical smaller diameter net holders, creating 2 finished vertical net supports;

(e) a net attached to the four vertical smaller diameter net holders;

(f) one or more ropes attached to the ground and to the finished vertical net supports; and (g) one or more base pieces secured to the bottom of each finished vertical net support.

2. The backstop of claim 1, comprising means for attaching the net to the backstop frame allowing changes to the acoustical responses generated when the net is struck.

3. The backstop of claim 2, comprising two foul line ropes attached to the backstop.

4. The backstop of claim 3, comprising base markers attached to the foul line ropes.

5. The backstop of claim 4, comprising a carrying bag able to enclose the backstop frame, net, strike zone, strike zone holder, foul line ropes and base markers.

6. The backstop of claim 1, comprising finished vertical net supports having top caps with one or more openings allowing rope to pass through the top caps.

7. The backstop of claim 6, comprising a strike zone attached to a solid, single piece fastener which attaches into the backstop net.

8. The backstop of claim 7 comprising one or more tension cords attached to the strike zone and net, by means allowing adjustment to the acoustical responses generated when the strike zone is struck.

9. The backstop of claim 8 further comprising one or more tension cords attached to the net and backstop frame by means allowing adjustment to the acoustical responses generated when the net is struck.

10. The backstop of claim 9, for use with balls weighing less than 5 ounces.

* * * * *